US012098007B2

(12) United States Patent
Greene et al.

(10) Patent No.: US 12,098,007 B2
(45) Date of Patent: Sep. 24, 2024

(54) APPARATUS AND METHOD FOR PACKING AND SHIPPING FORMED WRAPPING SHEETS

(71) Applicant: Jetram Products, LLC, St. Louis, MO (US)

(72) Inventors: Mike Greene, Olivette, MO (US); Lloyd Bedik, South Windsor, CT (US); Steven Trask, Granite City, IL (US); Marvin Dufner, Ladue, MO (US)

(73) Assignee: DECOWRAPS HOLDINGS, LLC, Doral, FL (US)

( * ) Notice: Subject to any disclaimer, the term of this patent is extended or adjusted under 35 U.S.C. 154(b) by 280 days.

(21) Appl. No.: 17/039,048

(22) Filed: Sep. 30, 2020

(65) Prior Publication Data

US 2021/0094741 A1 Apr. 1, 2021

Related U.S. Application Data

(60) Provisional application No. 62/908,928, filed on Oct. 1, 2019.

(51) Int. Cl.

| | |
|---|---|
| ***B65D 71/00*** | (2006.01) |
| ***B65B 5/06*** | (2006.01) |
| ***B65D 19/00*** | (2006.01) |

(52) U.S. Cl.

CPC ..... *B65D 71/0096* (2013.01); *B65B 5/06* (2013.01); *B65D 19/0028* (2013.01); *B65D 2519/00034* (2013.01); *B65D 2519/00069* (2013.01); *B65D 2519/00243* (2013.01); *B65D 2519/00273* (2013.01); *B65D 2519/00288* (2013.01); *B65D 2519/00323* (2013.01); *B65D 2519/00542* (2013.01); *B65D 2571/00067* (2013.01)

(58) Field of Classification Search

CPC ..... B65B 5/06; B65D 71/0096; B65D 2571/00067; B65D 71/08

USPC ..... 206/423, 497, 499

See application file for complete search history.

(56) References Cited

U.S. PATENT DOCUMENTS 1,398,030 A * 11/1921 Luellen ..... A47F 1/065 206/499

2,032,351 A * 3/1936 Chaplin ..... B65D 71/00 53/399

(Continued)

OTHER PUBLICATIONS

KIPO, International Search Report and Written Opinion (PCT/US2020/053596), Jan. 11, 2021, pp. 1-12.

(Continued)

*Primary Examiner* — Rafael A Ortiz

(74) *Attorney, Agent, or Firm* — UB Greensfelder LLP; Mark E. Stallion

(57) ABSTRACT

An apparatus and method for packaging and transportation of a preformed wrapping sheet is disclosed and claimed herein. One implementation of the technology as disclosed herein includes a method and apparatus for packaging and transportation of preformed wrapping sheets including "Pre-Formed Plant Covers" commonly referred to as a "Pot Cover" involving clear tubing constructed of a pliable material, including clear plastic tubing or other pliable material, and transportation storage racks assembled from substantially rigid pallets, including plastic pallets or other substantially rigid material, and corner boards, commonly known as beads.

5 Claims, 14 Drawing Sheets

(56) References Cited

U.S. PATENT DOCUMENTS

| | | | | |
|---|---|---|---|---|
| 5,310,052 | A * | 5/1994 | Bindman | B65D 71/08 206/509 |
| 5,741,535 | A * | 4/1998 | Cope | B65D 77/02 206/583 |
| 6,122,896 | A | 9/2000 | Weder | |
| 6,405,871 | B1 * | 6/2002 | Craig | B65D 5/5097 206/499 |
| 8,015,751 | B2 * | 9/2011 | Weder | B65B 25/02 47/72 |
| 2002/0121452 | A1 | 9/2002 | Craig et al. | |
| 2009/0159480 | A1 * | 6/2009 | Weder | B65D 85/07 206/499 |
| 2010/0307943 | A1 | 12/2010 | Hieronymus | |
| 2011/0220544 | A1 | 9/2011 | De Alba | |
| 2015/0076027 | A1 * | 3/2015 | Weder | B65D 19/385 206/499 |

OTHER PUBLICATIONS

European Patent Office, Partial Supplementary European Search Report for EP Application No. 20871735.5, mailed Oct. 2, 2023, 11 pages.

* cited by examiner

APPARATUS AND METHOD FOR PACKING AND SHIPPING FORMED WRAPPING SHEETS

CROSS-REFERENCE TO RELATED APPLICATIONS

The present invention claims priority to and the benefit of U.S. Provisional Patent Application No. 62/908,928 filed Oct. 1, 2019, the contents of which are incorporated herein by reference in its entirety and made a part hereof.

BACKGROUND

Field

This technology as disclosed herein relates generally to pre-formed wrapping sheets or cover, and more particularly, to forming, packing and shipping wrapping sheets or covers.

Background

A formed wrapping sheet and/or wrapping paper is commonly used as a decorative item to cover a flower pot or other container. Preforming the wrapping sheet and/or wrapping paper for its particular purpose and packaging and shipping the sheets in bulk quantities can pose challenges to maintaining intact the preformed shape of the sheets, while shipping the bulk quantities in an efficiently sized container because the preformed shape can be altered or deformed during to shipping.

A better apparatus and/or method is needed for improving packing and shipping bulk quantities of preformed wrapping sheets and/or wrapping paper.

SUMMARY

The technology as disclosed herein includes a method and apparatus for packaging and transportation of a preformed wrapping sheet. One implementation of the technology as disclosed herein includes a method and apparatus for packaging and transportation of preformed wrapping sheets including "Pre-Formed Plant Covers" commonly referred to as a "Pot Cover" involving clear tubing constructed of a pliable material, including clear plastic tubing or other pliable material, and transportation storage racks assembled from substantially rigid pallets, including plastic pallets or other substantially rigid material, and corner boards, commonly known as beads or corner beads. The corner boards are sufficiently rigid to prevent damage to the stacks of preformed sheets. To create this system the "Pot Cover" is stacked one inside another and is compacted to allow the maximum number of "Pot Covers" to be packed in a tube of about approximately 1.2 meters+/−0.3 meters, or other appropriate size depending on the size of the preformed sheets.

The stack of preformed sheets is compacted snuggly in the tubing (such as an elongated plastic tube shaped bag with one open end and an opposing distal sealed end) along the length of the tubing and the outer diameter of the stack is press fit against the inner diameter of the tubing for a snug fit. To insure the "Pot Cover" is not deformed during the compression process a sufficiently rigid container, such as a frustoconical, cup-shaped, container constructed of plastic or other sufficiently rigid frustoconical, cup-shaped, container constructed of another material, is placed over the bottom of the stack and a sufficiently rigid container, such as a frustoconical, cup shaped container constructed of plastic or other sufficiently rigid container constructed of another material, is placed inside the top "Pot Cover". The container has a form substantially the same as the preformed sheet, such as a frustum form.

The stack of covers is then placed into a plastic tube that is sealed at the lower end, such as being sealed with plastic tape at lower end, and a plastic tie is used at the top to close the top opening through which the sheet stack is inserted. For one implementation, labels to identify the product are placed on the side and the bottom of the stack. The finished and sealed tubes are then compactly stacked within a frame consisting of plastic base pallet or pallet constructed of another material, and four vertical corner boards fixedly attached to the pallet and eight horizontal supports at the top and the middle of the frame, fixedly attached to and between the corner boards. The tubes are stacked in the frame either vertically or horizontally depending on the size of the "Pot Cover" and then the frame is wrapped in clear stretch film for stability and preventing product slipping out between the corner boards during transportation.

This packaging and transportation system provides several advantages over previously used packing systems using corrugated cartons. The corner boards or corner beads are configured into a frame and not simply as a corner protector for a box being shipped. The packaging as disclosed and claimed herein of the "Pre-Formed Plant Covers" in pliable tubes, such as a pliable plastic tube, contributes to achieving and maintaining the desired shape of the "Pot Cover". The tubes of pot covers are not placed in corrugated boxes, where the loaded corrugated boxes are then stacked on a pallet, and the corner beads are not simply used as a corner protector wrapping around the corners of the boxes to reinforce the corner areas of the boxes, but are being utilized as a frame structure.

A smooth outside surface of the Pot Cover is achieved and maintained when the Pot Cover is removed from the plastic tubing after shipment. Compressing the stack from either end using a sufficiently rigid container, such as a frustoconical, cup-shaped, container constructed of plastic or other sufficiently rigid frustoconical, cup-shaped, container constructed of another material, that is placed over the bottom most Pot Cover of the stack and a sufficiently rigid container, such as a frustoconical, cup shaped container constructed of plastic or other sufficiently rigid container constructed of another material, is placed inside the top most "Pot Cover" in the stack and the stack is compressed from the bottom towards the top and from the top towards the bottom to thereby form a compressed stack of Pot Covers where the stack is lesser in length than an uncompressed stack.

The compressed stack combined with press fitting the compressed stack into the interior of a tube made of a pliable material, such as a pliable plastic, further combined with snugly packing the sealed tubes in the packing frame enclosed with shrink wrap reduces deformities in the outside surface of the Pot Covers when removed from the tubing after shipment and the Pot Covers have a visibly smoother appearance than "Pot Covers" packed and shipped using other systems. The packaging system also results in a more desirable angle of the flare or top crown of the Pot Cover. The compressed stack combined with the outer plastic tubular bag packaging ensures that the Plant Pot Covers has a more vertical flare rather than the less desirable more horizontal flare often found when using other packaging systems.

The packaging system also results in a significant reduction in cost, particularly as compared to the corrugated box type shipping systems. The PakLite™ System, as disclosed and claimed herein, reduces the physical space or volume required to pack, store and transport any quantity of "Pot Covers" by the anywhere from 30% to 60% depending on the size of the "Pot Cover". Often, other systems loosely pack the Pot Covers and/or provide other packing material or structures to assist in reducing deformation of the Pot Covers resulting in a larger volume being required as compared to the packing system as disclosed and claimed herein. The cost reduction provides both the manufacturer and the end user economic advantages including, reduced packaging costs, reduced warehouse space to store the "Pot Covers", and reduced transportation costs for the manufacturer; and reduced handling costs, reduced warehouse space, and reduced waste material disposal costs for the end user. The PakLite™ system substantially reduces the solid waste necessary to package and transport an equal number of "Pot Covers" packed and shipped in the commonly used corrugated cartons. The clear packaging of the pliable plastic tubes and the shrink wrap around the packing frame makes it easier to identify the product during the manufacturing and handling process and for the end user. For the Manufacturer, the product is easily identified during the shipping process, and for the end user, the clear packaging reduces the chance for transporting the wrong "Pot Covers" to remote locations.

Each sheet is pressed into a preformed frustum shaped cup-like under cover and a stack of preformed sheets is formed by sequentially compressing one preformed sheet inside a prior stacked preform sheet. The stack of preformed sheets have a frustum shape open ended container (or pot) placed over the bottom of the stack of preformed sheets and inside the top preformed sheet, to insure the "Pot Cover" is not deformed during the compression process. The containers are at the top and bottom of the stack. The stack of covers is then placed into a tube (sleeve) that is sealed at the lower end and the plastic elongated tubular bag is tied at the top end with a tie. The finished tubes containing the Pot Cover compressed stacks are then compactly stacked within a frame consisting of plastic base and four vertical corners and eight horizontal supports at the top and the middle of the frame. For one implementation, the four vertical corners or corner beads, are vertically erected elongated corner moldings or corner bands the have an elbow shaped or "L" shaped cross section thereby forming a corner support structure. For one implementation, support members are attached between the tops of each of the corner beads. For yet another implementation, support members are attached between each of the corner beads about midway along the length of the corner beads.

The features, functions, and advantages that have been discussed can be achieved independently in various implementations or may be combined in yet other implementations further details of which can be seen with reference to the following description and drawings.

These and other advantageous features of the present technology as disclosed will be in part apparent and in part pointed out herein below.

BRIEF DESCRIPTION OF THE DRAWINGS

For a better understanding of the present technology as disclosed, reference may be made to the accompanying drawings in which.

Figure 1A:
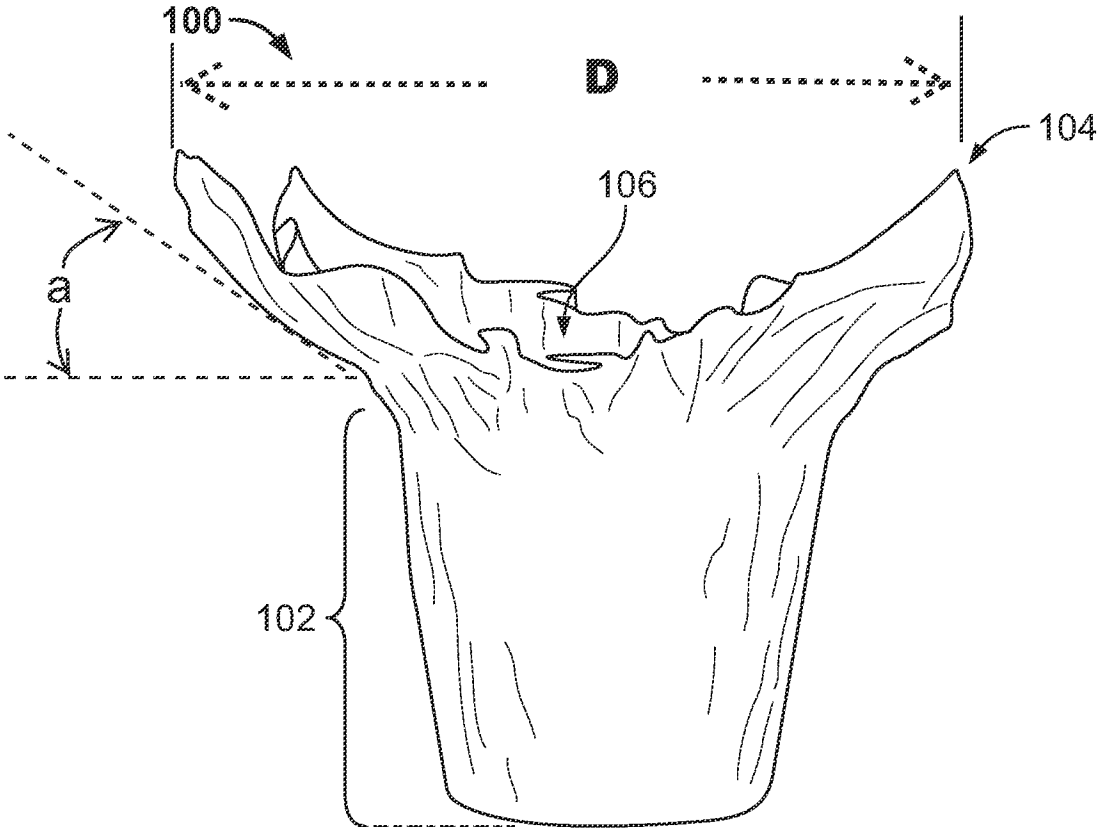
FIG. 1A is an illustration of a preformed frustum shaped cup-like under cover.

While the technology as disclosed is susceptible to various modifications and alternative forms, specific implementations thereof are shown by way of example in the drawings and will herein be described in detail. It should be understood, however, that the drawings and detailed description presented herein are not intended to limit the disclosure to the particular implementations as disclosed, but on the contrary, the intention is to cover all modifications, equivalents, and alternatives falling within the scope of the present technology as disclosed and as defined by the appended claims.

DESCRIPTION

According to the implementation(s) of the present technology as disclosed, various views are illustrated in FIG. 1-3 and like reference numerals are being used consistently throughout to refer to like and corresponding parts of the technology for all of the various views and figures of the drawing. Also, please note that the first digit(s) of the reference number for a given item or part of the technology should correspond to the Fig. number in which the item or part is first identified. Reference in the specification to "one embodiment" or "an embodiment"; "one implementation" or "an implementation" means that a particular feature, structure, or characteristic described in connection with the embodiment or implementation is included in at least one embodiment or implementation of the invention. The appearances of the phrase "in one embodiment" or "in one implementation" in various places in the specification are not necessarily all referring to the same embodiment or the same implementation, nor are separate or alternative embodiments or implementations mutually exclusive of other embodiments or implementations.

One implementation of the present technology as disclosed teaches an apparatus and method for packaging and transportation of Pre-Formed Plant Pot Covers commonly referred to as a "Pot Cover" involving clear plastic tubing and transportation storage racks assembled from plastic pallets and corner boards, commonly known as corner beads or beads and support members, with the assembly wrapped in a plastic shipping wrap, for example a plastic shrink wrap or a plastic stretch wrap.

Figure 1B:
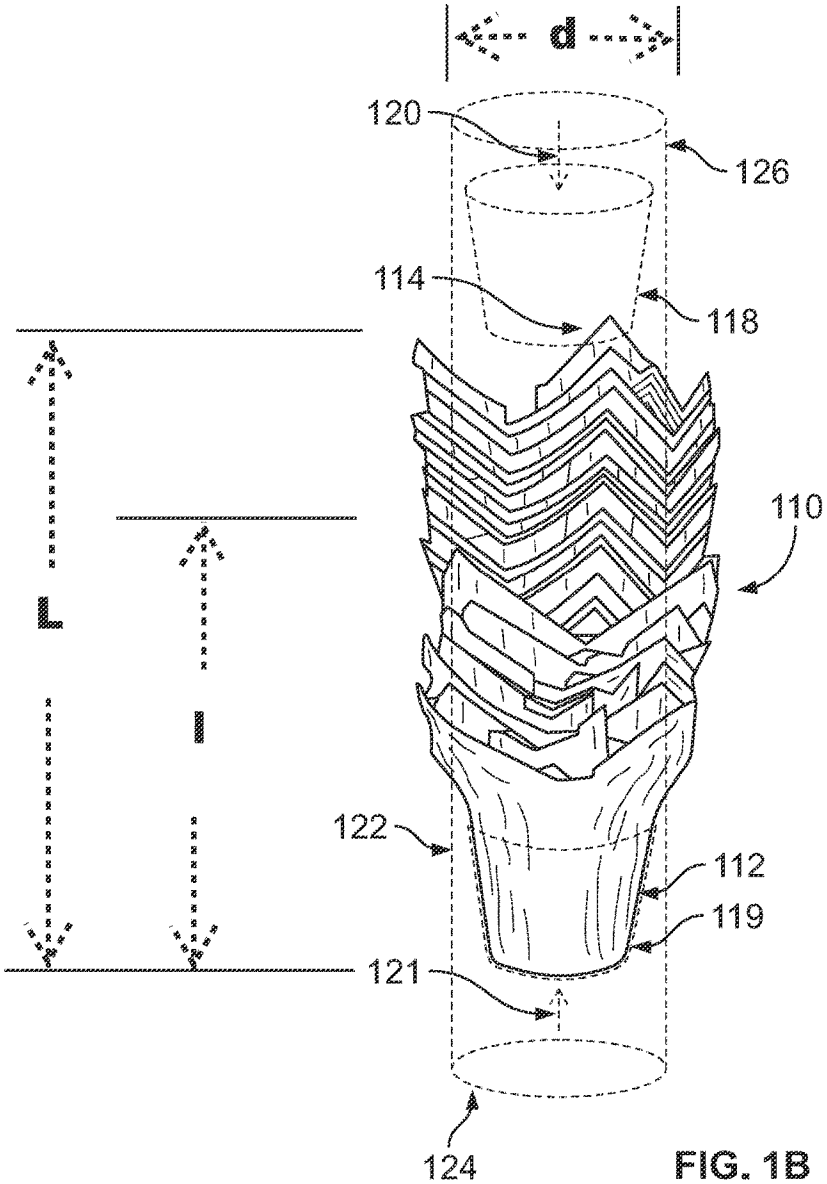
FIG. 1B is an illustration of a stack of preformed sheets.
Figure 1C:
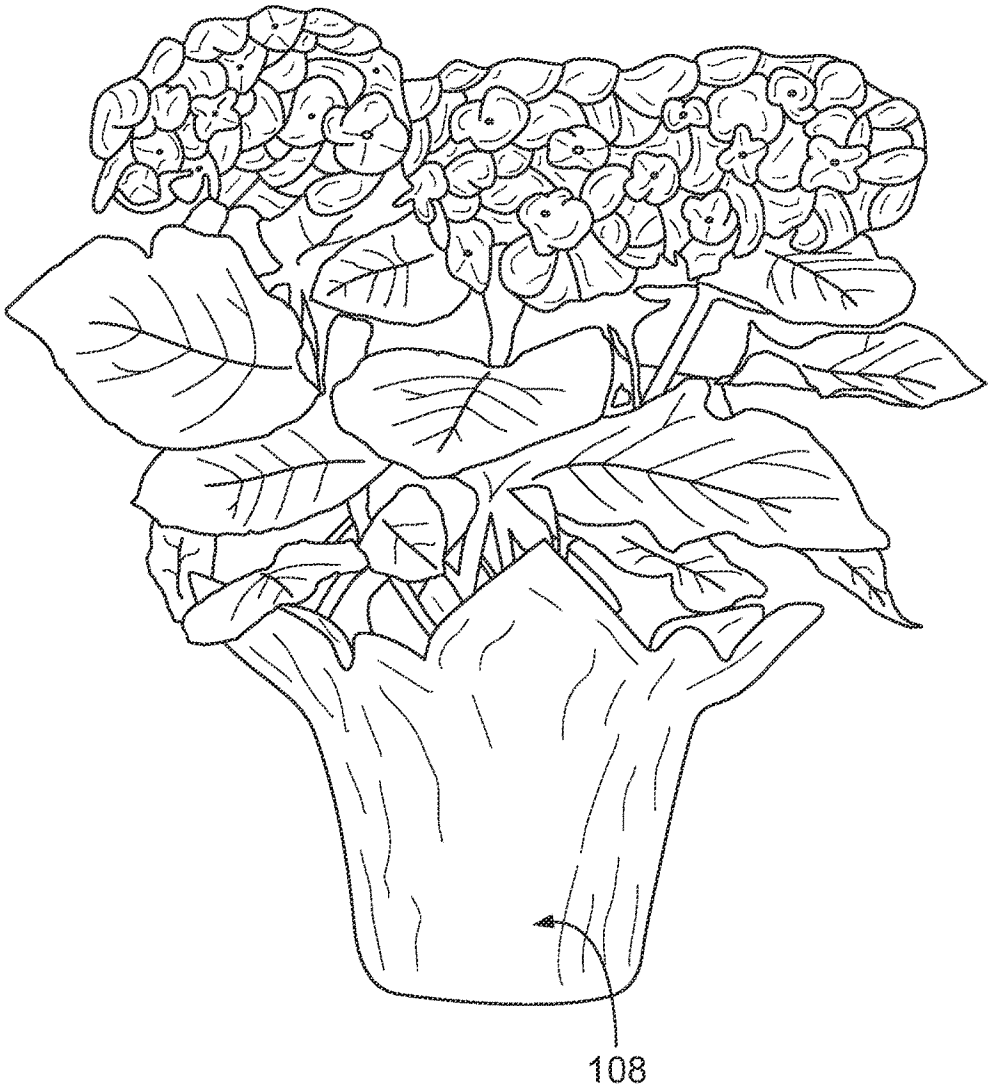
FIG. 1C is an illustration of a preformed sheet installed as a flower pot cover.

The details of the technology as disclosed and various implementations can be better understood by referring to the figures of the drawing. Referring to FIG. 1A and FIG. 1B and FIG. 1C, which show an illustration of a preformed frustum shaped cup-like under cover 100, which can be utilized as a decorative pot cover as illustrated in FIG. 1C. The undercover 100 is a preformed sheet, where the form of the main body 102 of the undercover 100 is a frustum shape or frustoconical cup shape. The undercover 100 also includes a flare portion 104 or crown portion that extends away from the top of the main body 102 at an angle a that is more vertical than horizontal. It is desirable that the angle "a" is greater than 45 degrees with respect to horizontal. The illustration in FIG. 1A provides a view of the undercover 100 that has not yet been packed. The undercover is somewhat cup shaped with top opening 106. The sheet can be made various types of material including tissue paper or paper stock with a foil coating.

FIG. 1B shows an illustration of a stack of preformed sheets 110. The stack includes the lower most cup 112 and the upper most cup 114. The stack can be compressed together where each preformed sheet is inserted into the preformed sheet immediately below, with the exception of the bottom preformed sheet. One implementation of the technology as disclosed herein includes a method and apparatus for packaging and transportation of "Pre-Formed Plant Covers" commonly referred to as a "Pot Cover" involving clear plastic tubing 122 and transportation storage racks assembled from plastic pallets and corner boards, commonly known as beads or corner beads. To create this system the "Pot Cover" is compacted to allow the maximum number of "Pot Covers" to be packed in a tube 122 of approximately 1.2 meters in lengthe or other appropriate size and lengthe depending on the size of the preformed sheets. To insure the "Pot Cover" is not deformed during the compression process a plastic container 119, a frustoconical cup shaped container as illustrated, is placed over the bottom most pot cover 112 of the stack and inside the top most "Pot Cover" 114 of the stack. The container 119 is placed over the bottom most pot cover 112 and the container 118 is placed inside the top most pot cover 114.

Each sheet is pressed into a preformed frustum shaped cup-like under cover and a stack of preformed sheets is formed by sequentially compressing one preformed sheet inside a prior stacked preform sheet. The stack of preformed sheets have a frustum shape open ended container (or pot) placed over the bottom of the stack of preformed sheets and inside the top preformed sheet, to insure the "Pot Cover" is not deformed during the compression process. The containers are at the top and bottom, 118 and 119 respectively, of the stack. Compressing the stack from either end using a sufficiently rigid containers 118 and 119, such as a frustoconical, cup-shaped, container constructed of plastic or other sufficiently rigid frustoconical, cup-shaped, container constructed of another material, that is placed over the bottom most Pot Cover of the stack and a sufficiently rigid container, such as a frustoconical, cup shaped container constructed of plastic or other sufficiently rigid container constructed of another material, is placed inside the top most "Pot Cover" in the stack and the stack is compressed from the bottom towards the top, as indicated by directional arrow 121 and from the top towards the bottom, as indicated by directional arrow 120, to thereby form a compressed stack of Pot Covers where the stack is lesser in length than an uncompressed stack.

Figure 2A:
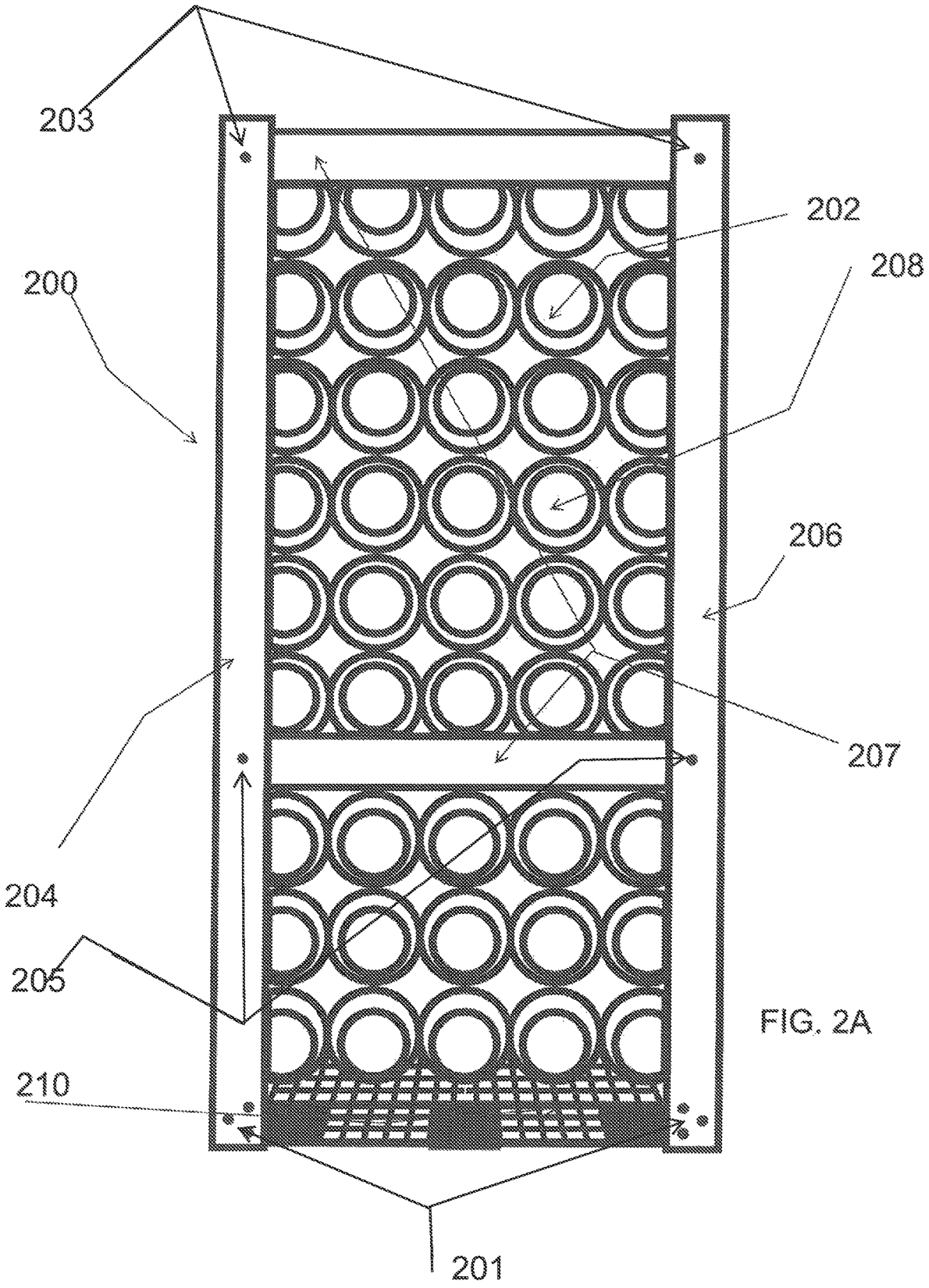
FIG. 2A is an illustration of a rear view of a shipping frame containing a plurality of tubes packed with stacked preformed sheets.

The stack of covers is then placed into a plastic tube 122 that is sealed with Plastic tape at lower end 124 and a plastic tie at the top end 126. For one implementation, the lower end 124 of the plastic tube is pre-sealed. The labels to identify the product are placed on the side and the bottom of the stack. The finished tubes are then compactly stacked within a frame assembly 200 including a base 210 of plastic or other like material, where the base can be a plastic pallet and four vertical corners, two of which are illustrated in FIG. 2A shown as items 204 and 206 and eight horizontal supports, two of which are illustrated in FIG. 2A, shown as items 207 at the top and the middle of the frame. The corner beads 204 and 206 are fixedly attached to the pallet 210, by fasteners 201 that penetrate both the corner bead and the pallet to thereby fixedly attach the corner bead and the pallet. The fastener 201 is one or more of a nail, tack, rivet, staple or other appropriated fastener. The middle and top lateral support members 207 are fixedly attached to the corner beads 204 and 206 by fasteners 203 and 203, which penetrate the both the lateral support member and the corner bead to fixedly attach the support member with the bead. The fasteners 203 and 205 are one or more of a nail, tack, rivet, staple or other appropriated fastener. The tubes are stacked in either vertically or horizontally depending on the size of the "Pot Cover" and then wrapped in clear stretch film for stability during transportation. The compressed stacks, as illustrated in FIG. 2A, illustrate the stack oriented horizontally. FIG. 2A illustrates the bottom end of the stacks with the frustoconical cup shaped bottom container in place. FIG. 1C shows an illustration of a preformed sheet 108 installed as a flower pot cover after shipment. FIG. 2A shows an illustration of a rear view of a shipping frame containing a plurality of tubes packed with stacked preformed sheets. The bottom end of the stacks 202 and 208 are illustrated.

Figure 2B:
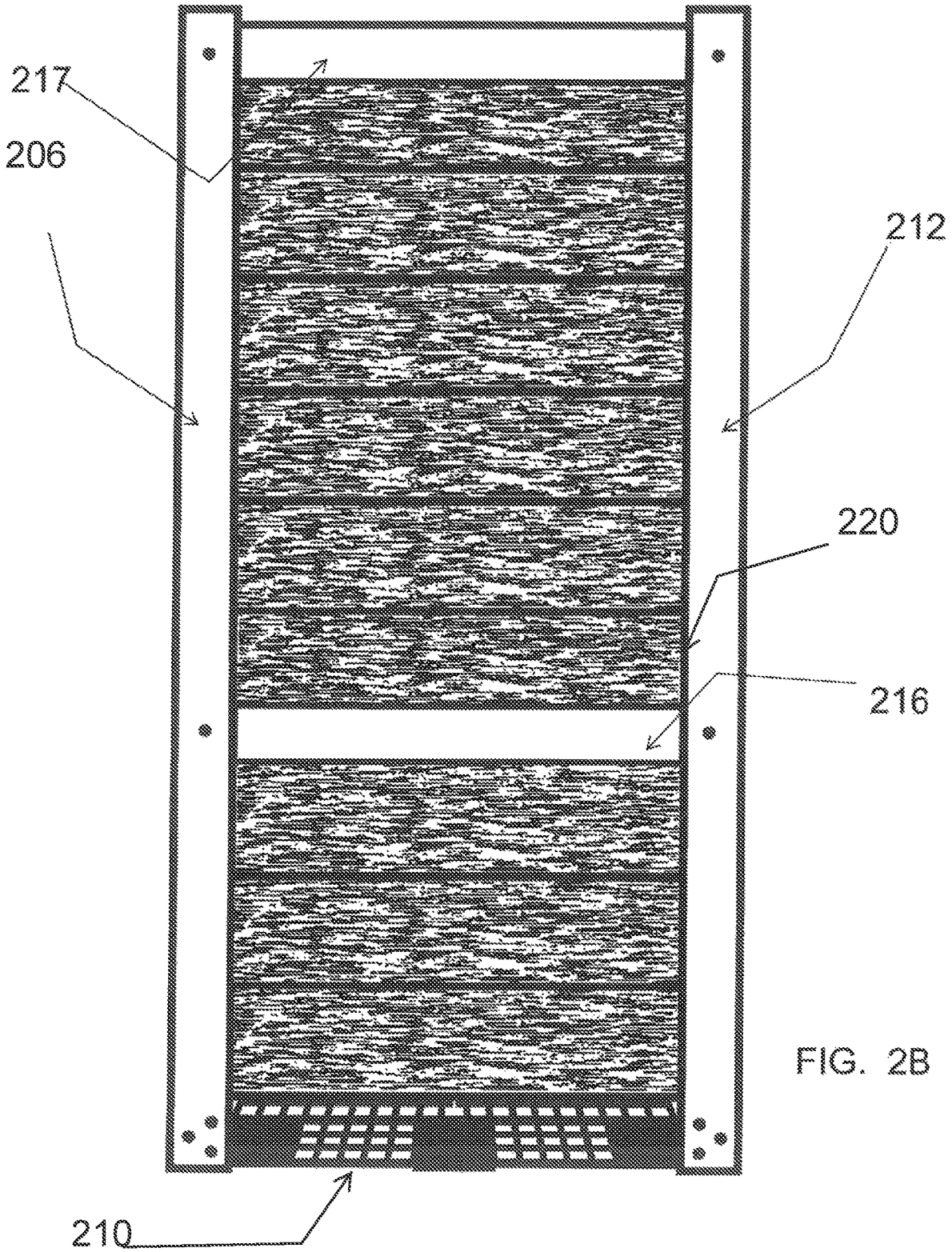
FIG. 2B is an illustration of a side view of a shipping frame containing a plurality of tubes packed with stacked preformed sheets.
Figure 2C:
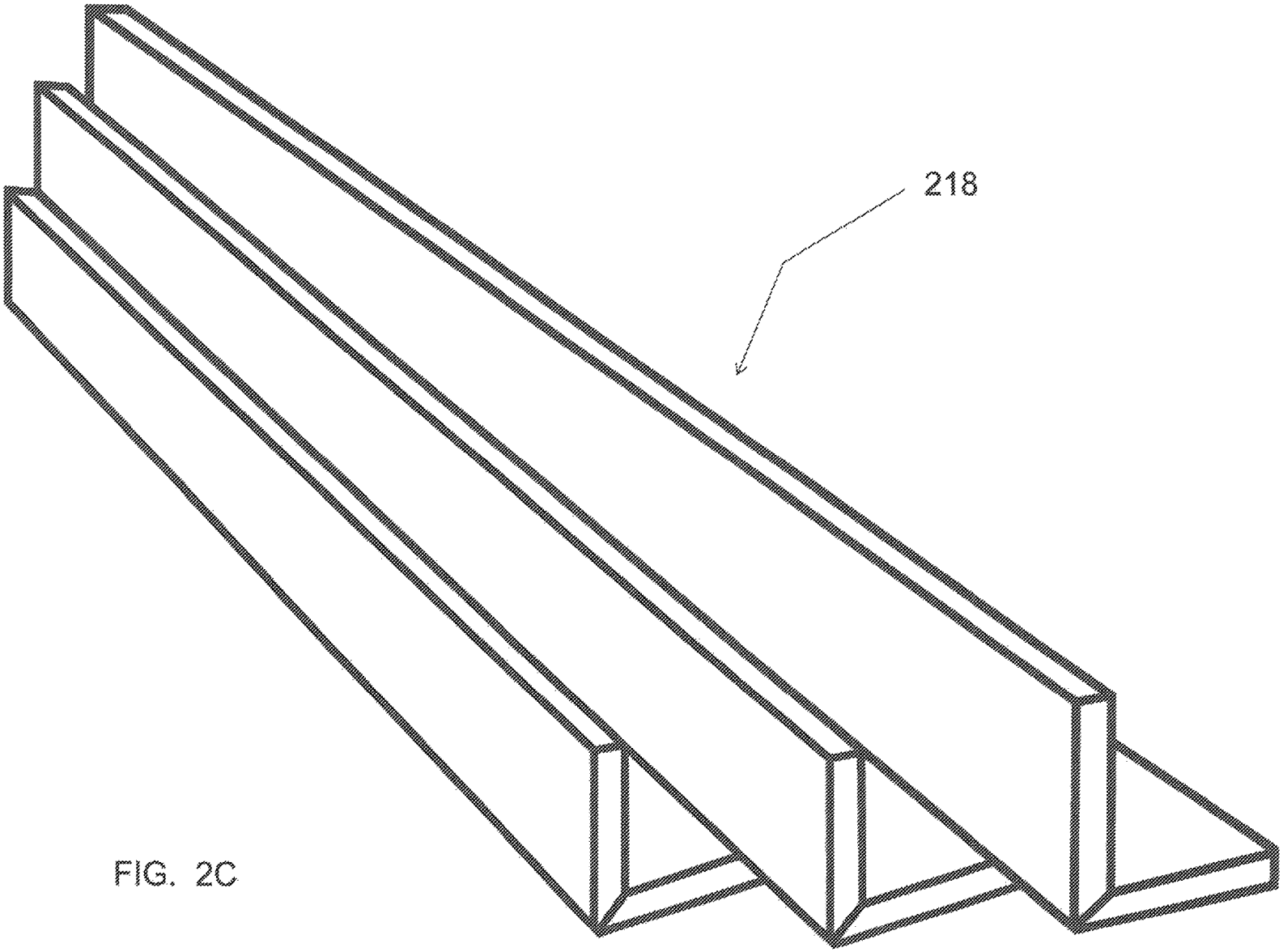
FIG. 2C is an illustration of the corner panels of the shipping frame.

FIG. 2B shows an illustration of a side view of a shipping frame containing a plurality of tubes 220 packed with stacked preformed sheets. As illustrated in FIGS. 2A and 2B, for one implementation, the tubes 220 are stacked with a horizontal orientation. The shipping frame, includes, a base pallet 210 and four vertical corners as illustrated by items 204, 206, 212 and 214 (not shown) and eight horizontal supports at the top and the middle of the frame as illustrated by items 207, 216 and 217. FIG. 2C shows an illustration of the corner panels, or corner boards, commonly known as corner beads or corner guards, of the shipping frame. The corner beads 218 are elongated and have an elbow shaped or "L" shaped lateral cross section. The corner beads, for one implementation, are constructed of a semi-rigid material such a pressed paper board material, compressed fiber board, angleboard or similar material. The opposing side view (not shown) of the shipping frame assembly 200 is identical to that shown in FIG. 2B. For one implementation, the lateral crossing support members are elongated with a lateral cross section similar to that of the corner beads as illustrated in FIG. 2C.

Figure 3A:
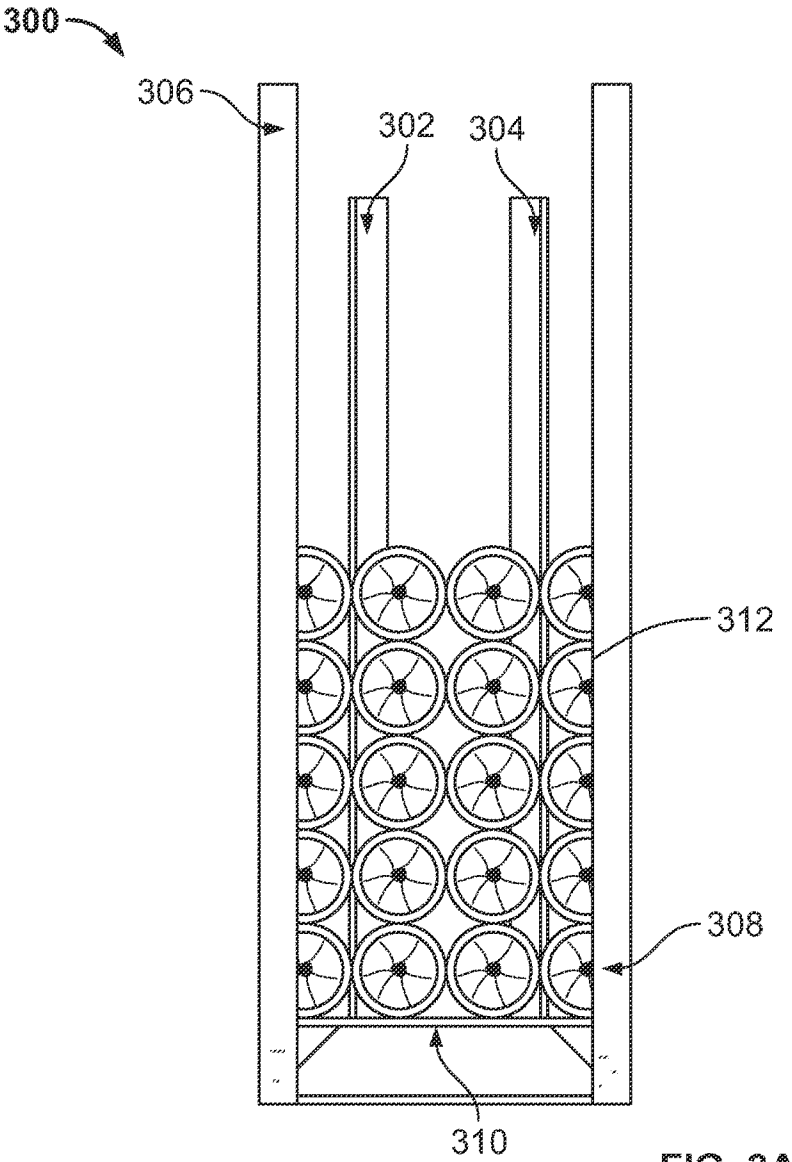
FIG. 3A is an illustration of a front view of a shipping frame partially filled with a plurality of tubes packed with stacked preformed sheets.
Figure 3C:
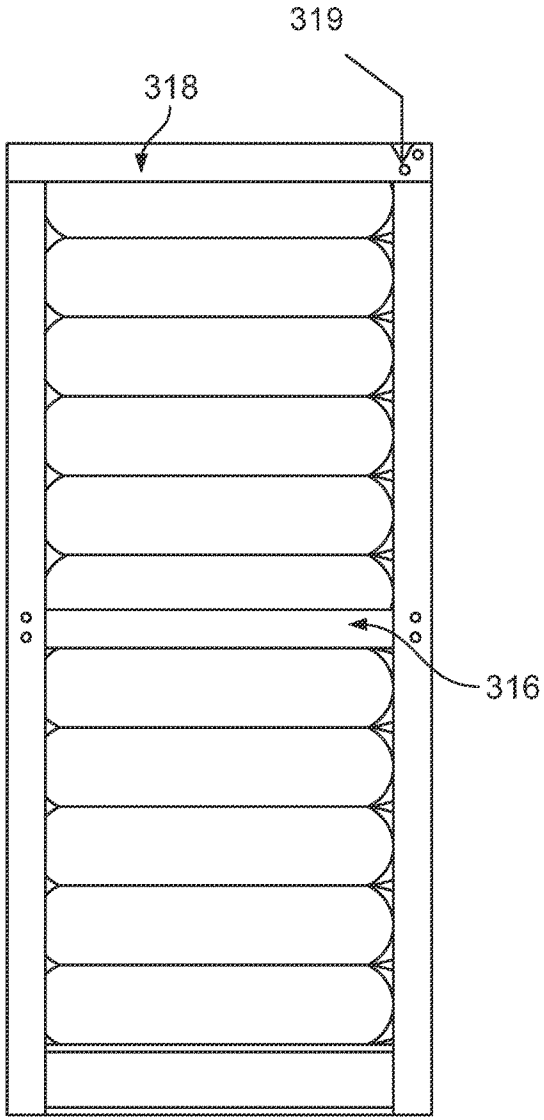
FIG. 3C is an illustration of a side view of a shipping frame containing a plurality of tubes packed with stacked preformed sheets.
Figure 3B:
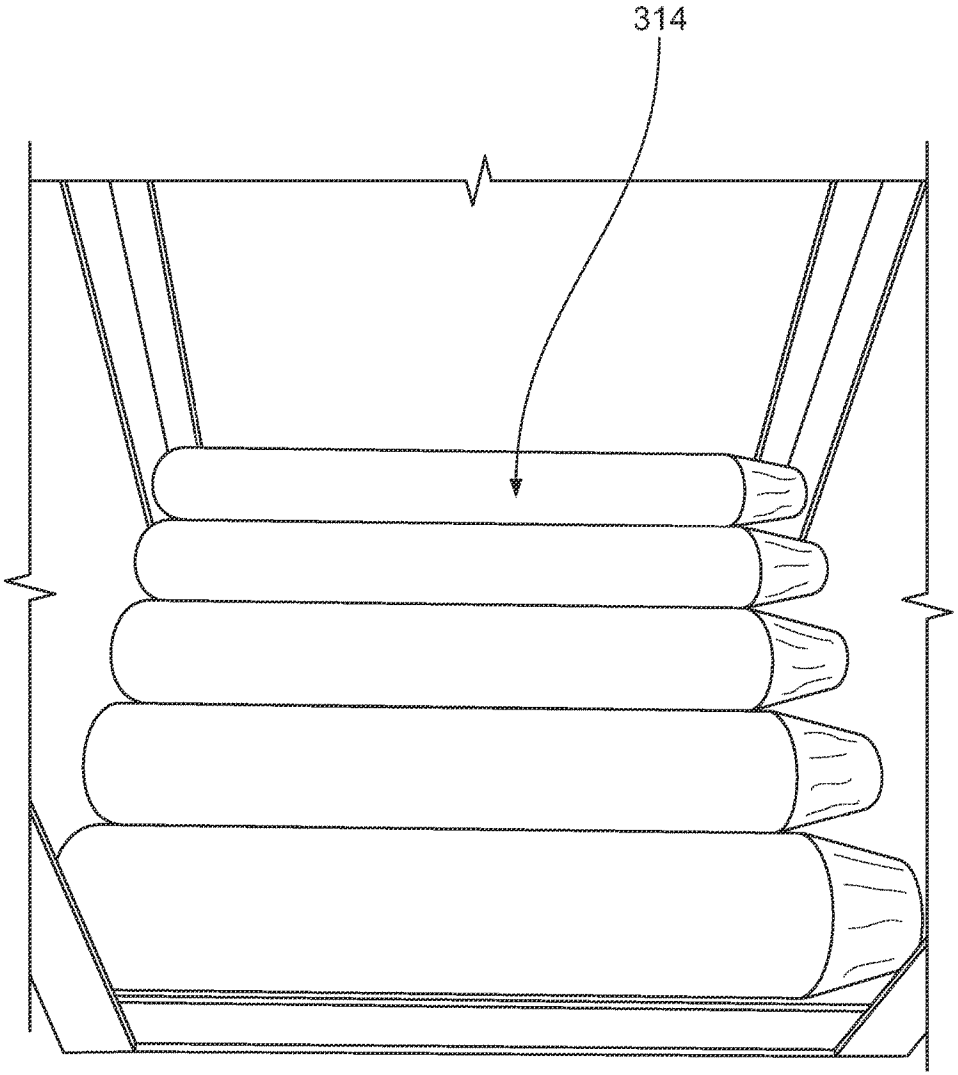
FIG. 3B is an illustration of an isometric view of a shipping frame partially filled with a plurality of tubes packed with stacked preformed sheets.
Figure 3E:
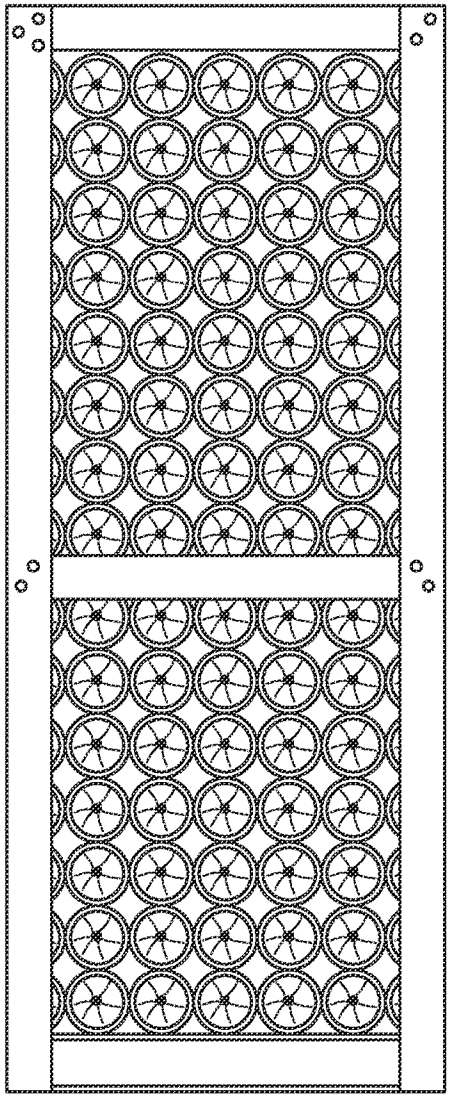
FIG. 3E is an illustration of a front view of a shipping frame containing a plurality of tubes packed with stacked preformed sheets.
Figure 3D:
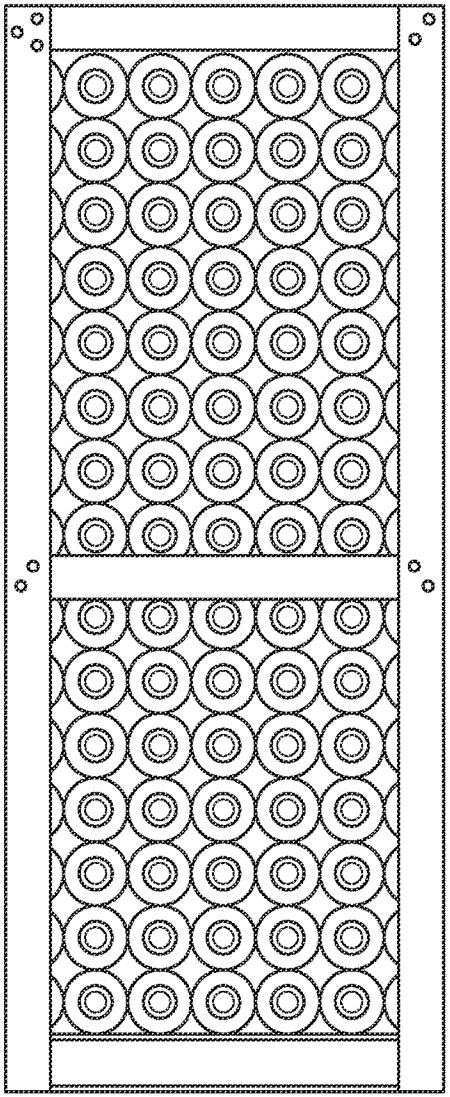
FIG. 3D is an illustration of a rear view of a shipping frame containing a plurality of tubes packed with stacked preformed sheets.

FIG. 3A shows an illustration of an isometric front view of a shipping frame partially filled with a plurality of tubes packed with compressed stacked preformed sheets. The shipping frame 300, includes, a base pallet 310 and four vertical corners as illustrated by corner beads 302, 304, 306 and 308 and eight horizontal supports at the top and the middle of the frame, which are not illustrated in this view as illustrated. FIG. 2C shows an illustration of the corner panels, or corner boards, commonly known as corner beads or corner guards, of the shipping frame. FIG. 3B shows an illustration of an isometric view of a shipping frame partially filled with a plurality of tubes 314 packed with stacked preformed sheets. FIG. 3C shows an illustration of a side view of a shipping frame containing a plurality of tubes packed with stacked preformed sheets and illustrates the top support member 318 and the middle support member 316. The top support members, as illustrated by 318, are elongated and have an L-shaped lateral cross section similar to the corner beads. The top support members are orthogonally attached end to end with the adjacent top support member where the ends overlap, such that when four top support members are attached in a rectangular configuration and attached over the corner beads, a top support structure is created. An end to end orthogonal overlapping attachment of adjacent top support members attached over a top of a corner bead forms a top corner support structure. The top lateral crossing support members are fixedly attached end to end by fasteners and the corners of the top support members are attached to the corner beads by fasteners 319. FIG. 3D shows an illustration of a rear view of a shipping frame containing a plurality of tubes packed with stacked preformed sheets. FIG. 3D illustrates the bottom end of the plastic tube bags that are transparent plastic, which illustrates the bottom compression frustoconical compression cup. FIG. 3E illustrates the top end of the plastic tub bags that are transparent plastic, which illustrates the top of the tubular bags being closed or cinched by a plastic bag tie. The top lateral support members as illustrated in FIGS. 3D and 3E, that are orthogonally attached end to end, are shown attached to the inside of the vertical corner beads rather than over the top and outside the corner beads as illustrated in FIG. 3C.

Figure 3F:
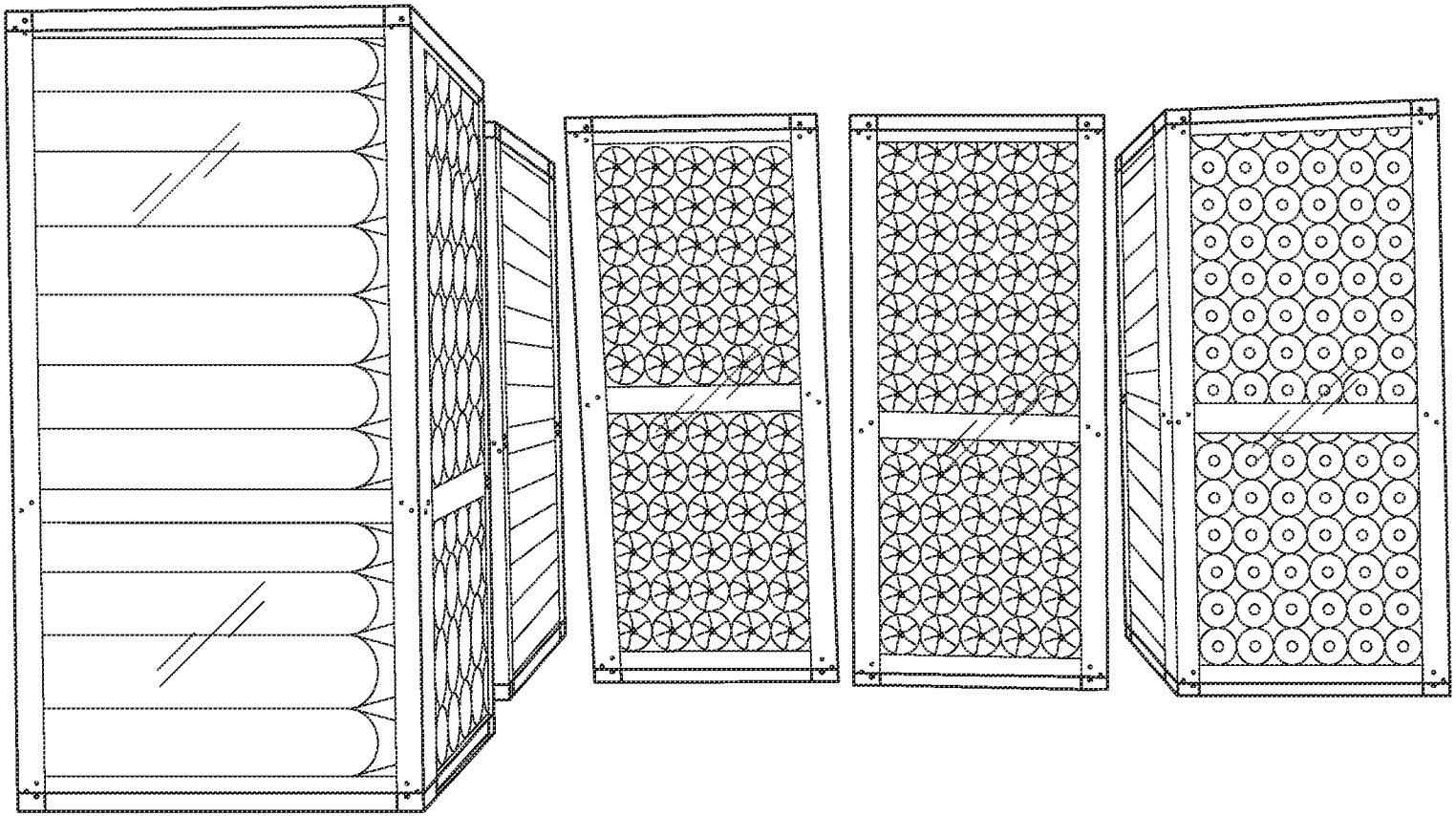
FIG. 3F is an illustration of a plurality of shipping frames wrapped about its exterior with plastic wrap and stored in a warehouse.
Figure 3G:
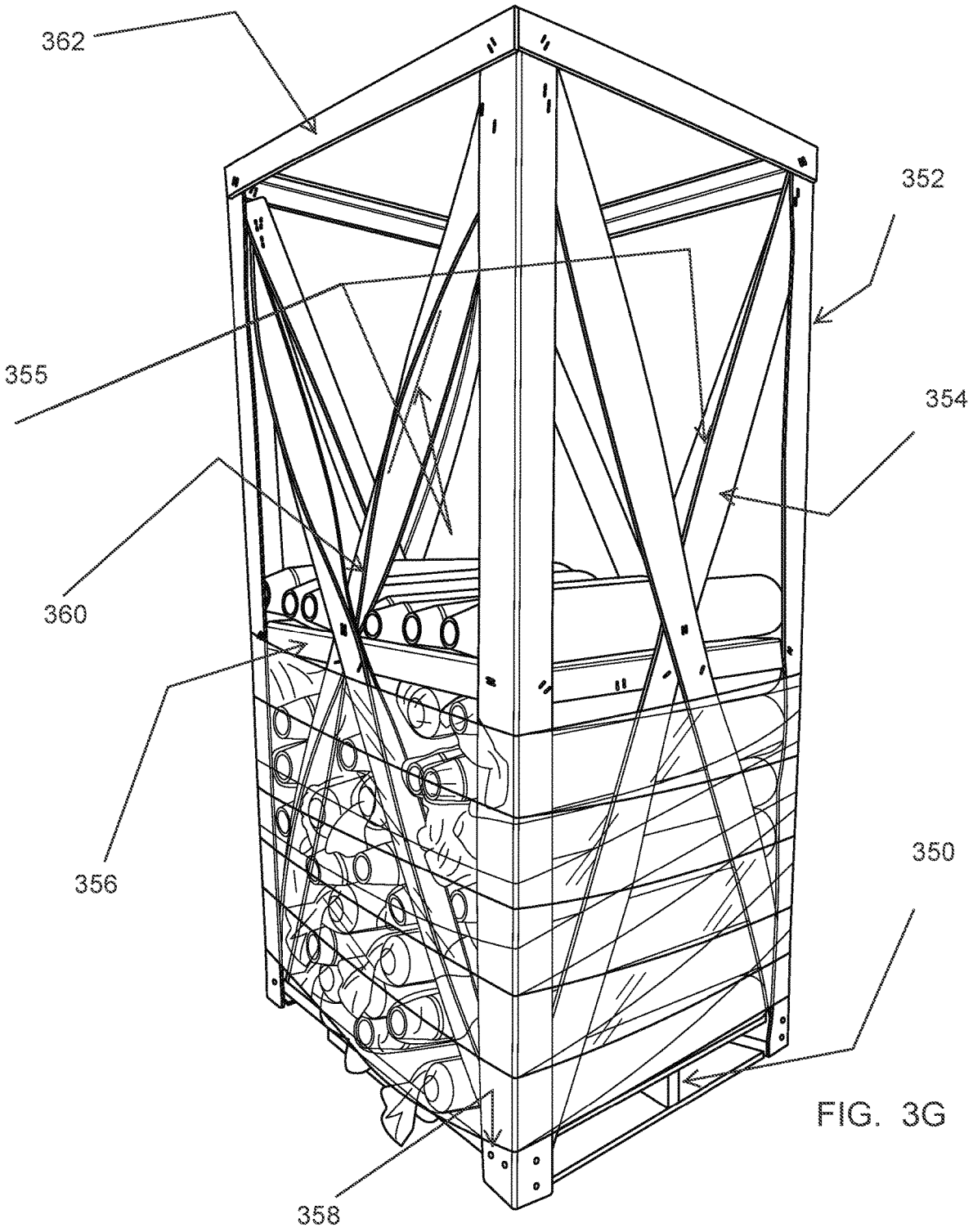
FIGS. 3G through 3J are an illustration of a shipping frame with crisscrossing members.

FIG. 3E shows an illustration of a front view of a shipping frame containing a plurality of tubes packed with stacked preformed sheets. FIG. 3D shows an illustration of a front view of a shipping frame containing a plurality of tubes packed with stacked preformed sheets. FIG. 3F shows an illustration of a plurality of shipping frames wrapped about its exterior with plastic wrap and stored in a warehouse and ready for shipment and/or unpacking. For one implementation, the shipping frame includes a shipping frame with crisscrossing members as illustrated in FIG. 3G by items 354 and 360. The shipping frame illustrated in FIG. 3G. includes a base pallet 350, having attached thereto, vertically extending corner bead members as illustrated by item 352. The shipping frame further includes mid-tier or middle members extending between the corner bead members as illustrated by item 356. The middle support member 356 as illustrated, is elongated and has a lateral L-shaped cross section similar to that of the corner beads. In this implementation, the middle lateral support members are orthogonally attached end to end by fasteners forming a rectangular structure and the rectangular structure of the middle lateral support members are attached to the inside corners of the corner beads between the top portion and the bottom portion of the vertically extending corner beads. For one implementation, the shipping frame includes top support members extending between the top portions of the corner beads as illustrated by item 362. The top support member 362 as illustrated is elongated and has a lateral L-shaped cross section similar to that of the corner beads. As illustrated in FIG. 3G, the crisscrossing members, as illustrated by items 354 and 360, are elongated and have a lengthwise crease 355 extending end to end, as illustrated by item 355, about which the crisscrossing member has a lateral or crosswise fold to thereby strengthen the member to be a two-ply member.

Figure 3H:
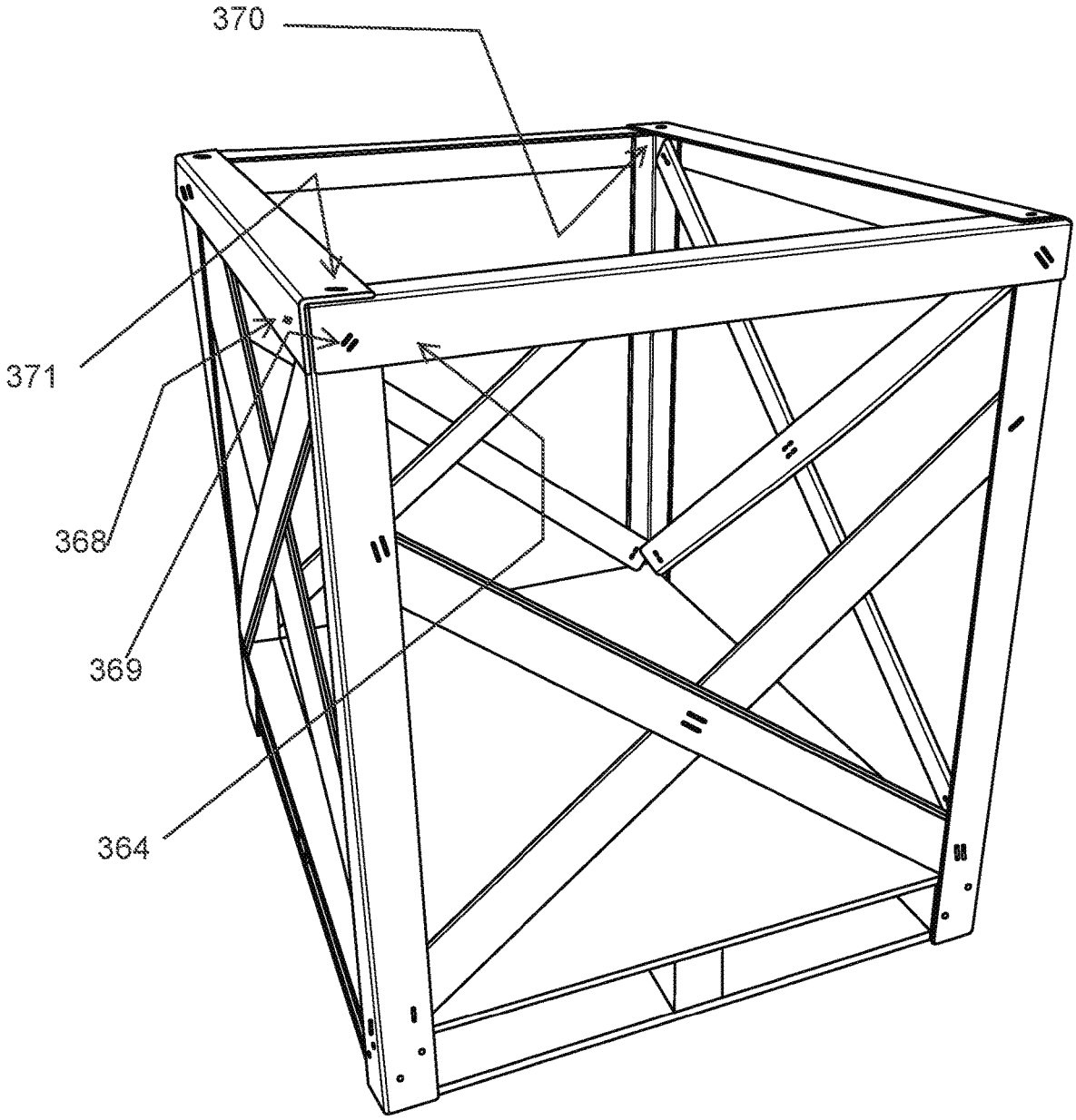
Figure 3I:
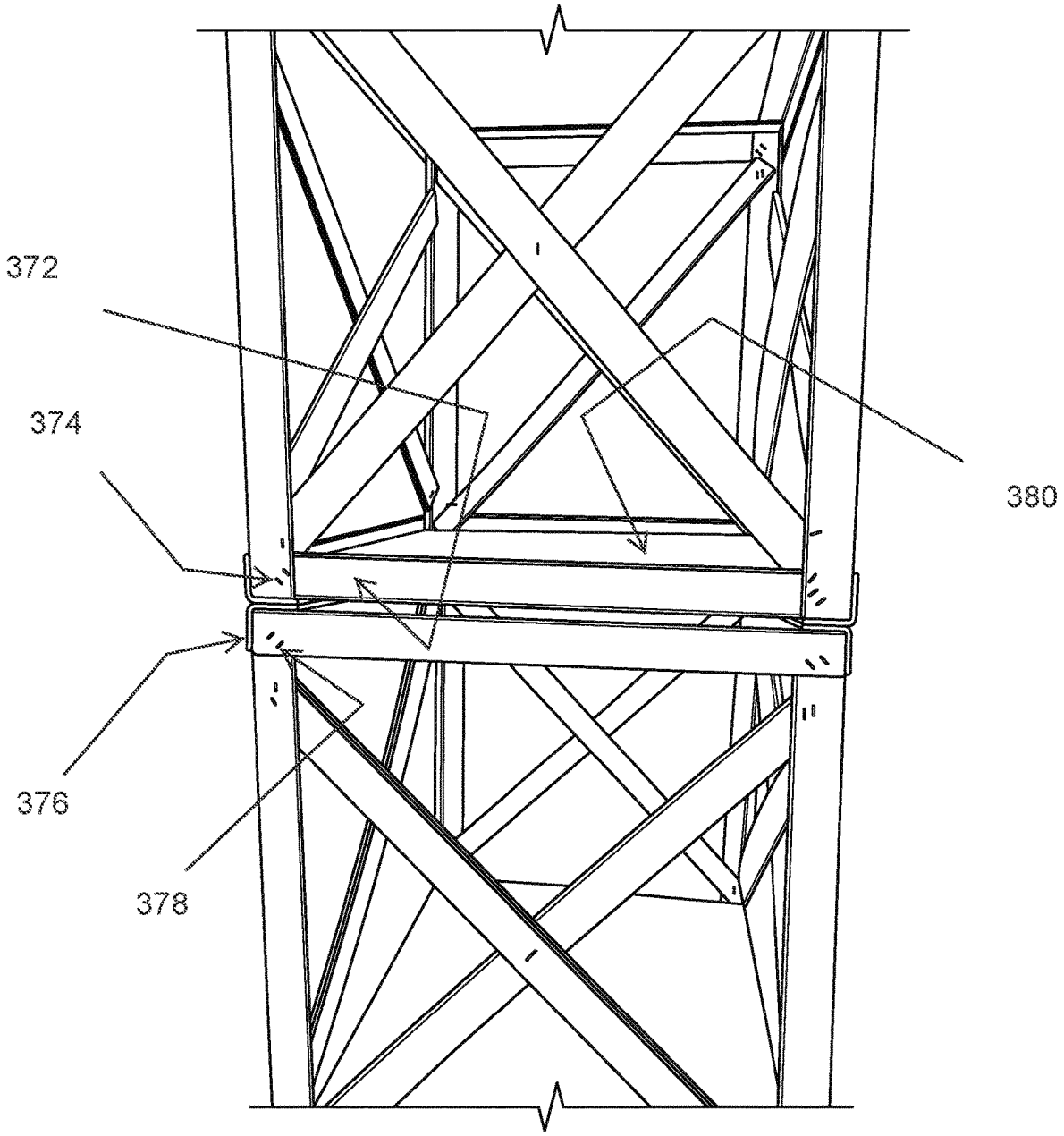
Figure 3J:
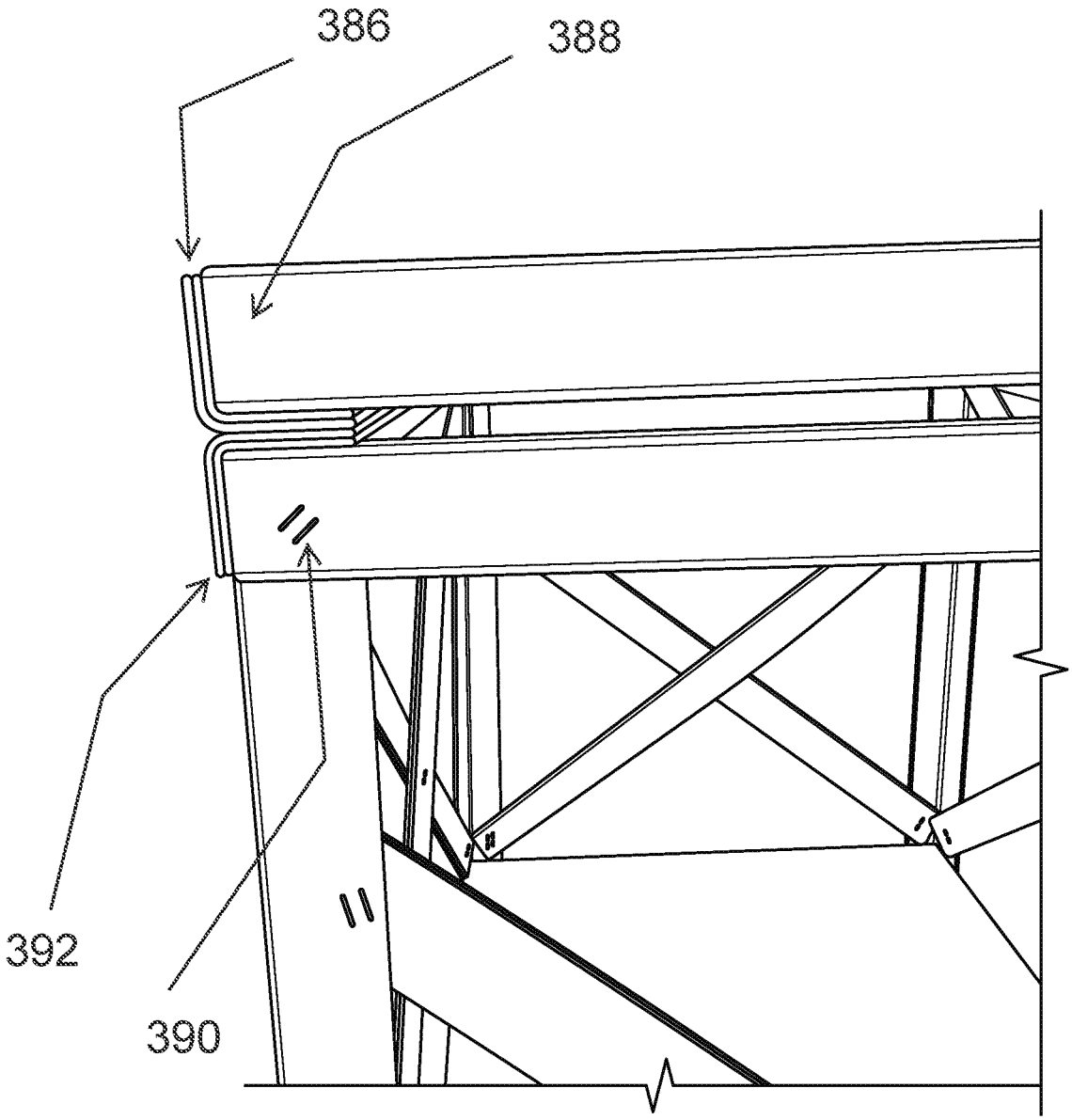

Referring to FIG. 3H, a stackable shipping frame is illustrated. The top support members, as illustrated by items 364 and 368, extend between and attached to the top portions of adjacent vertically extending corner beads. The top support members are elongated and have an L-shaped lateral cross section similar to the corner beads. The top support members, as illustrated by items 364 and 368, are orthogonally attached end to end with the adjacent top support member where the ends overlap, such that when four top support members are attached with a fastener, as illustrated by 371, in a rectangular configuration and attached over the corner beads with a fastener, as illustrated by 369, a top support structure is created. An end to end orthogonal overlapping attachment of adjacent top support members attached over a top of a corner bead forms a top corner support 370. For one implementation, the top support members are doubled to form a two-ply strengthened top support member. Referring, to FIG. 3I, stacked shipping frames are illustrated with the main shipping frame at the bottom having a base pallet and vertically extending corner beads, and with the second shipping frame stacked on top of the main shipping frame. The base of the second shipping frame is constructed of base support members that are elongated and have an L-shaped lateral cross section similar to the corner beads. The bottom support members, as illustrated by items 372, are orthogonally attached end to end with the adjacent bottom support member where the ends overlap, such that when four bottom support members are attached in a rectangular configuration and attached with a fastener, as illustrated by 374, over or inside (as shown) the bottom portion of the corner beads, and a bottom support structure is created. An end to end orthogonal overlapping attachment of adjacent bottom support members are attached over a bottom of a corner bead, which therefore forms a bottom corner support. The bottom corner support structure is stacked over a top corner support structure of the shipping frame on the bottom, where the top corner support structure is formed from orthogonally attached end to end support members, as illustrated by items 376 and 378, with the adjacent support member where the ends overlap, such that when four top support members are attached in a rectangular configuration and attached over the corner beads, a top support structure is created. An end to end orthogonal overlapping attachment of adjacent top support members attached over a top of a corner bead forms a top corner support. The corner beads and support members are attached using a fastener, such as a nail, or staple or other appropriate fastener. Referring to FIG. 3J, the bottom corner support structure is stacked over a top corner support structure of the shipping frame on the bottom, where the top corner support structure is formed from orthogonally attached end to end support members, as illustrated by items 390 and 392, with the adjacent support member where the ends overlap, such that when four top support members are attached in a rectangular configuration and attached over the corner beads, a top support structure is created. An end to end orthogonal overlapping attachment of adjacent top support members attached over a top of a corner bead forms a top corner support. The bottom corner support structure is formed from orthogonally attached end to end support members, as illustrated by items 386 and 388, with the adjacent support members where the ends overlap, such that when four bottom support members are attached in a rectangular configuration and attached over the corner beads, a bottom support structure is created. An end to end orthogonal overlapping attachment of adjacent top support members attached over a bottom of a corner bead that forms a corner support. As illustrated, the support members can be stacked to form a two-ply support member for added strength. For one implementation of the shipping frame, the support members and the corner beads are constructed of a semi-rigid material such a pressed paper board material, compressed fiber board, angleboard or similar material.

For one implementation of the subject matter as disclosed and claimed herein, a packaging for a preformed sheet includes a stack of frustum shaped preformed sheets, stacked one inside another, where a bottom frustum shaped container is placed over a bottom frustum preformed sheet of the stack of frustum shaped preformed sheets, and where a top frustum shaped container placed inside a top pre-formed sheet of the stack of frustum shaped preformed sheets. For one implementation, the stack of preformed sheets, the bottom frustum shaped container placed over the bottom frustum preformed sheet, and the top frustum shaped container place inside the top preformed sheet are press fit into a plastic tube that is sealed, where the plastic tube has an un-stretched diameter d that is less than the largest diameter D of the bottom frustum shaped preformed sheet, thereby forming a tube of stacked preformed sheet.

For one implementation the stack of preformed sheets, and the bottom plastic frustum shaped container placed over the bottom frustum preformed sheet, and the top frustum shaped container place inside the top preformed sheet are linearly compressed to thereby form a compressed tube of stacked preformed sheets such that the length l of the stack is less than the length L of the stack of preformed sheets in an un-compressed state.

For one implementation of the packaging of the preformed sheet, the compressed tube of stacked preformed sheets are stacked with a plurality of other compressed tubes of stacked preformed sheets within a shipping frame assembly where the shipping frame assembly includes a base and a plurality of corner beads extending vertically up from the base and a plurality of horizontal supports where each of the plurality of horizontal supports are attached between two of the plurality of corner beads. For one implementation of the packaging, a continuous sheet of plastic stretch wrap is completely wrapped around the perimeter of the shipping frame assembly, where said perimeter is defined by the plurality of corner beads. For one implementation of the packaging, the compressed tube of stacked preformed sheets are stacked within the shipping frame assembly with a plurality of other compressed tubes of stacked preformed sheets with either a horizontal orientation or a vertical orientation.

For one implementation of the subject matter a method for packing preformed sheets includes stacking a plurality of frustum shaped performed sheets, one inside another and placing a bottom frustum shaped container over a bottom frustum preformed sheet of the stack and placing a top frustum shaped container inside of a top preformed sheet of the stack of preformed streets. One implementation of the method includes press fitting the stack of preformed sheets, and the bottom frustum shaped container placed over the bottom frustum preformed sheet, and the top frustum shaped container place inside the top preformed sheet into a plastic tube that is sealed, where the plastic tube has an un-stretched diameter that is less than the largest diameter of the bottom frustum shaped container, thereby forming a tube of stacked preformed sheets.

For one implementation of the method for packing preformed sheets, the method includes linearly compressing the stack of preformed sheets, and the bottom plastic frustum shaped container placed over the bottom frustum preformed sheet, and the top frustum shaped container place inside the top preformed sheet, thereby forming a compressed tube of stacked preformed sheets such that the length of the stack is less than the stack of preformed sheets in an un-compressed state. For one implementation, the method includes stacking said compressed tube of stacked preformed sheets with a plurality of other compressed tubes of stacked preformed sheets within a shipping frame assembly, where the shipping frame assembly includes a base and a plurality of corner beads extending vertically up from the base and a plurality of horizontal supports where each of the plurality of horizontal supports are attached between two of the plurality of corner beads. One implementation of he method for packing preformed sheets includes wrapping a continuous sheet of plastic stretch wrap completely around the perimeter of the shipping frame assembly, where said perimeter is defined by the plurality of corner beads. The compressed tubes of stacked preformed sheets are stacked with either a horizontal orientation or a vertical orientation.

For one implementation of the subject matter as disclosed and claimed herein a shipping frame assembly includes, a shipping pallet base having a plurality of side corners, and includes a plurality of elongated L-shaped corner beads having an L-shaped lateral cross section, where each of the plurality of elongated L-shaped corner beads have a top end and a bottom end at a distal end of each of the elongated L-shaped corner beads with respect to the top end, and where each said bottom end is fixedly attached at one of the plurality of side corners of the shipping pallet base, and where each of the plurality of elongated L-shaped corner beads extend vertically to the top end. For one implementation of the subject matter, the shipping frame assembly includes, a vertically oriented sheet of plastic stretch wrap completely wrapped around a perimeter defined by the plurality of elongated L-shaped corner beads that are vertically extending to the top end, to thereby for a side wall from the sheet of plastic stretch wrap.

For one implementation of the shipping frame assembly a horizontally extending elongated top crossing member is included and attached to one of the plurality of elongated L-shaped corner beads proximate the top end of the one of the plurality of elongated L-shaped corner beads, and the horizontally extending elongated top crossing member horizontally extends and attaches to an adjacent elongated L-shaped corner bead proximate the top end of the adjacent elongated L-shaped corner bead. For one implementation of the shipping frame assembly the horizontally extending elongated top crossing member has a second L-shaped cross section. For one implementation of the shipping frame assembly, the shipping frame assembly includes a horizontally extending an elongated middle crossing member attached to one of the plurality of elongated L-shaped corner beads proximately equidistant between the top end and the bottom end of the one of the plurality of elongated L-shaped corner beads, and said horizontally extending elongated middle crossing member horizontally extending and attached to an adjacent elongated L-shaped corner bead proximately equidistant between the top end and the bottom end of the adjacent elongated L-shaped corner bead. For one implementation of the shipping frame assembly, the horizontally extending elongated middle crossing member has a third L-shaped cross section.

For one implementation of the shipping frame assembly a diagonally extending elongated crisscrossing member is attached to one of the plurality of elongated L-shaped corner beads proximate the top end of the one of the plurality of elongated L-shaped corner beads, and the diagonally extending crisscrossing member diagonally extends and attaches to an adjacent elongated L-shaped corner bead proximate the bottom end of the adjacent elongated L-shaped corner bead.

For one implementation of the subject matter, the diagonally extending elongated crisscrossing member has a lengthwise crease extending end to end, and said diagonally extending elongated crisscrossing member is folded along the crease in order to double the thickness and improve upon the integrity of the base.

The various packaging and shipping frame examples shown above illustrate an apparatus and method for packaging and transportation of "Pre-Formed Plant Covers" commonly referred to as a "Pot Cover" involving clear plastic tubing and transportation storage racks assembled from plastic pallets and corner boards, commonly known as beads. A user of the present technology as disclosed may choose any of the above implementations, or an equivalent thereof, depending upon the desired application. In this regard, it is recognized that various forms of the subject technology could be utilized without departing from the scope of the present invention.

As is evident from the foregoing description, certain aspects of the present technology as disclosed are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the scope of the present technology as disclosed and claimed.

Other aspects, objects and advantages of the present technology as disclosed can be obtained from a study of the drawings, the disclosure and the appended claims.

What is claimed is:

1. A packaging for a preformed sheet, comprising:

a stack of frustum shaped preformed sheets, stacked one inside another;

a bottom frustum shaped container placed over a bottom frustum preformed sheet of the stack of frustum shaped preformed sheets;

a top frustum shaped container placed inside a top preformed sheet of the stack of frustum shaped preformed sheets; and said stack of preformed sheets, and said bottom frustum shaped container placed over the bottom frustum preformed sheet, and said top frustum shaped container place inside the top preformed sheet press fit into a plastic tube that is sealed, and said plastic tube having an un-stretched diameter that is less than the largest diameter of the bottom frustum shaped preformed sheet, thereby forming a tube of stacked preformed sheets.

2. The packaging for a preformed sheet as recited in claim 1, where said stack of preformed sheets, and said bottom plastic frustum shaped container placed over the bottom frustum preformed sheet, and said top frustum shaped container place inside the top preformed sheet are linearly compressed thereby forming a compressed tube of stacked preformed sheets such that the length of the stack is less than the stack of preformed sheets in an un-compressed state.

3. The packaging of the preformed sheet as recited in claim 2, comprising:

said compressed tube of stacked preformed sheets stacked with a plurality of other compressed tubes of stacked preformed sheets within a shipping frame assembly including a base and a plurality of corner beads extending vertically up from the base and a plurality of horizontal supports where each of the plurality of horizontal supports are attached between two of the plurality of corner beads.

4. The packaging of the preformed sheet as recited in claim 3, comprising:

a continuous sheet of plastic stretch wrap completely wrapped around the perimeter of the shipping frame assembly, where said perimeter is defined by the plurality of corner beads.

5. The packaging of the preformed sheet as recited in claim 4, where the compressed tube of stacked preformed sheets are stacked within the shipping frame assembly with the plurality of other compressed tubes of stacked preformed sheets with either a horizontal orientation or a vertical orientation.

* * * * *